US007942140B2

(12) United States Patent
Kawamata et al.

(10) Patent No.: US 7,942,140 B2
(45) Date of Patent: May 17, 2011

(54) MICROBUBBLE GENERATOR FOR A FUEL TANK

(75) Inventors: Noriyuki Kawamata, Saitama (JP); Kazuto Fukuzawa, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 418 days.

(21) Appl. No.: 12/210,474

(22) Filed: Sep. 15, 2008

(65) Prior Publication Data

US 2009/0084367 A1 Apr. 2, 2009

(30) Foreign Application Priority Data

Sep. 28, 2007 (JP) ..... 2007-253357

(51) Int. Cl.
*F02M 29/00* (2006.01)

(52) U.S. Cl. ..... 123/590; 261/75

(58) Field of Classification Search ..... 123/585, 123/590–593; 261/75
See application file for complete search history.

(56) References Cited

U.S. PATENT DOCUMENTS 6,382,601 B1 * 5/2002 Ohnari ..... 261/79.2

FOREIGN PATENT DOCUMENTS

JP 2000236762 A * 9/2000
JP 2007-24012 A 2/2007

* cited by examiner

*Primary Examiner* — Noah Kamen
(74) *Attorney, Agent, or Firm* — Birch, Stewart, Kolasch & Birch, LLP

(57) ABSTRACT

A microbubble generator includes a fuel pump for pumping fuel with an introduction pipe for guiding the liquid toward the inlet of the fuel pump. An air pipe includes one end joined with the introduction pipe from the side, and the other end opened as an air inlet. A bubble generating orifice is disposed in an output side pipe of the fuel pump. The air pipe is formed of an intake air pipe and a joint side air pipe. An air amount adjustment orifice is disposed at a joint portion between the joint side air pipe and the introduction pipe. The bubble generating orifice has a taper portion with the diameter reduced from the input side to the output side.

20 Claims, 7 Drawing Sheets

MICROBUBBLE GENERATOR FOR A FUEL TANK

CROSS-REFERENCE TO RELATED APPLICATIONS

The present application claims priority under 35 USC 119 to Japanese Patent Application No. 2007-253357 filed on Sep. 28, 2007 the entire contents of which are hereby incorporated by reference.

FIELD OF THE INVENTION

The present invention relates to a microbubble generator provided with a pump.

DESCRIPTION OF BACKGROUND ART

The microbubble with a considerably small diameter to be mixed with the liquid exhibits various functions, the usage of which has been under development. For example, JP-A No. 2007-24012 discloses the application of a microbubble generator to a system for supplying the fuel to the engine of the vehicle. In JP-A No. 2007-24012, the fuel is fed to the microbubble generator outside the tank by the pump inside the tank via the fuel supply passage. The fuel then passes through the ultrasonic generator so as to be supplied to the fuel injection unit.

The generated microbubble with respect to the fuel becomes uniform to be mixed therewith. The temperature of the fuel just before supply to the fuel injection unit may be instantaneously uniformized through irradiation of the ultrasonic wave to the microbubble.

The microbubble generator disclosed in JP-A No. 2007-24012 is markedly large in size, and is required to be disposed separately from the fuel pump, resulting in the layout difficulty. It is difficult to mount such a generator in the vehicle with the limited layout space, for example, with respect to a motorcycle. Additionally, the generally employed microbubble generator is quite expensive.

SUMMARY AND OBJECTS OF THE INVENTION

It is an object of an embodiment of the present invention to provide a microbubble generator which is small in size and inexpensive, and preferably applicable to a motorcycle.

The microbubble generator according to an embodiment of the present invention includes a combination of features including the following features.

A microbubble generator includes a pump for pumping out a liquid, an introduction pipe for introducing the liquid to an inlet of the pump, an air pipe having one end joined with the introduction pipe, and the other end opened as an air inlet, and a microbubble generation unit disposed in an output side pipe of the pump. The pump and the microbubble generation unit are disposed adjacent with each other.

As the air pipe is connected to the introduction pipe of the pump, and the microbubble generating unit is disposed at the output side of the pump, the microbubble generator becomes small in size and inexpensive. The pump and the microbubble generating unit are disposed adjacent with each other so as to further reduce the size of the microbubble generator.

An air amount adjustment orifice is disposed at a joint between the air pipe and the introduction pipe. The air amount adjustment orifice suppresses the generation amount of the microbubble.

The air amount adjustment orifice is provided to be replaceable. As a result, the generation amount of the microbubble may be variably adjusted.

A mesh filter is disposed downstream of the microbubble generating unit in the output side pipe. The mesh structure further refines the microbubble.

As the filter is provided in the air pipe, intrusion of the foreign matter into the pump may be prevented.

The microbubble generating unit is an orifice with a tapered shape having a diameter reduced from an input side to an output side, which facilitates generation of the microbubble.

The liquid is used as a fuel for an internal combustion engine, and stored in a fuel tank. The pump is a fuel pump. The pump and the microbubble generating unit are disposed in the fuel tank. In the case where at least the fuel pump and the microbubble generating unit are disposed within the fuel tank, most of the part of the microbubble generator is stored inside the fuel tank. So its volume is not substantially increased, which is convenient for the layout. The provision of the microbubble generator hardly reduces the capacity of the fuel tank.

The air pipe is in contact with or fixed to an outer surface of a filler opening cylinder of the fuel tank. The filler opening of the fuel tank is not immersed in the fuel, thus enabling air to be introduced through the opening of the air pipe. The filler opening cylinder is shaped to protrude into the inner hollow portion of the fuel tank, which is suitable for fixing the air pipe.

At least a portion of the air pipe is fixed to a wall of the fuel tank. The microbubble generator with the stable air pipe is applicable to the vibrating system such as the vehicle.

The air pipe is a unit formed by combining a lid which forms a portion of a wall of the fuel tank, the pump and the microbubble generating unit. This makes it possible to simplify the assembly work of the microbubble generator with the fuel tank, and the maintenance work.

The air pipe is formed of a first pipe which includes the one end, a second pipe which includes the other end, and a joint pipe which connects the first and the second pipes. The first pipe is a unit formed by combining a lid which forms a portion of a wall of the fuel tank, the pump and the microbubble generating unit. The second pipe is fixed to a portion of the fuel tank other than the lid. The joint pipe connects openings of the first and the second pipes.

In the case where the lid, the pump and the microbubble generating unit are combined into a single unit, the first pipe may be easily assembled with the fuel tank and maintained. The first and the second pipes may be easily joined with the joint pipe.

The first pipe includes an external opening through the lid. The second pipe includes an external opening through a wall of the fuel tank at a portion other than the lid. The structure makes it possible to join the first and the second pipes outside the fuel tank, resulting in the easy assembly work.

The other end of the air pipe is opened inside the fuel tank. This makes it possible to prevent an intrusion of foreign matter into the air pipe.

The aforementioned microbubble generator is small in size and inexpensive, and applicable to the motorcycle with the limited layout space.

In the microbubble generator according to an embodiment of the present invention, the air pipe is joined with the introduction pipe of the pump, and the microbubble generating unit is disposed at the output side of the pump, resulting in the compact and inexpensive structure.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An embodiment of the microbubble generator according to the present invention will be described referring to FIGS. 1 to 7.

Figure 1:
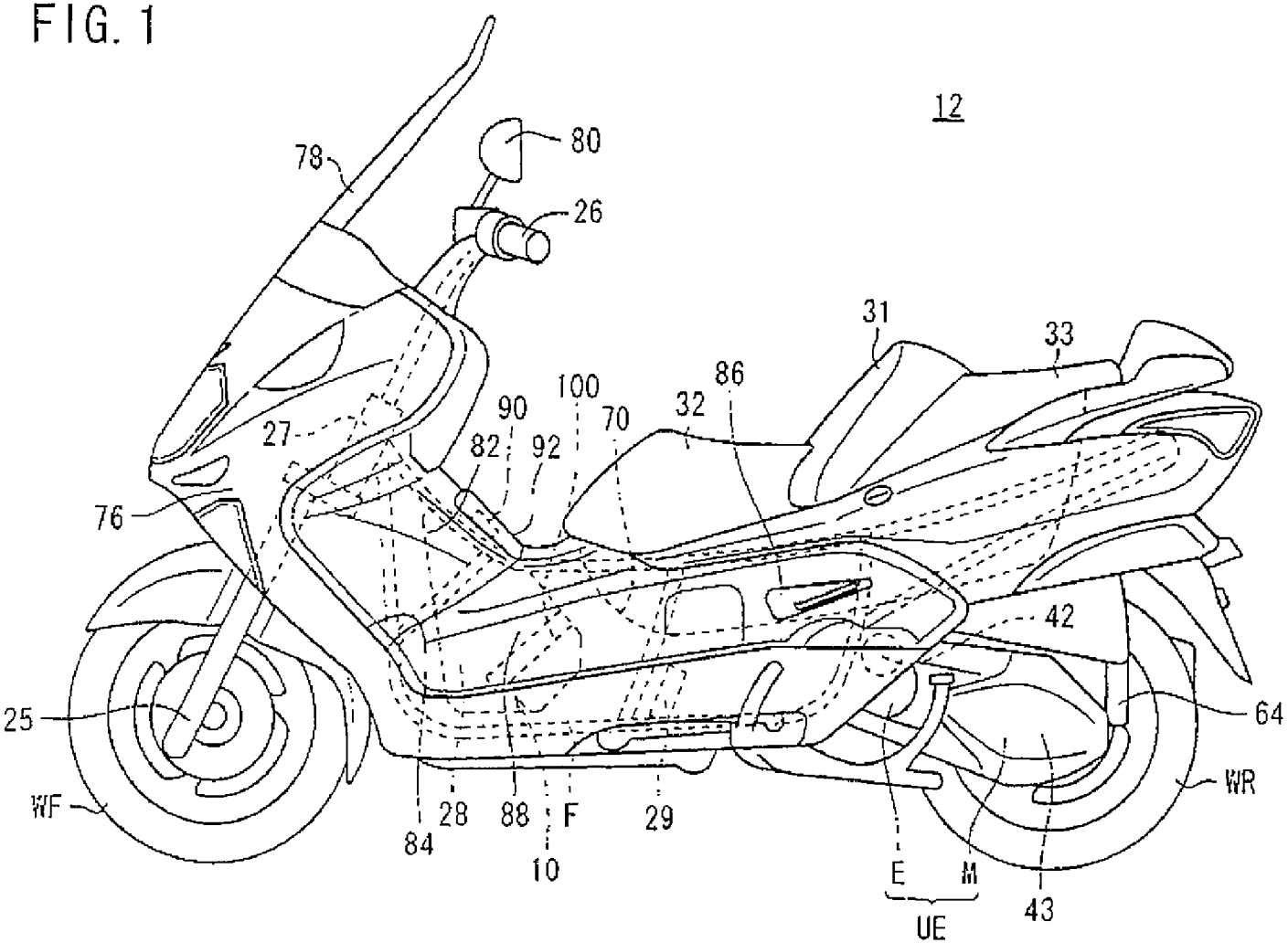
FIG. 1 is a side view of a motorcycle on which a microbubble generator according to an embodiment is mounted.
Figure 2:
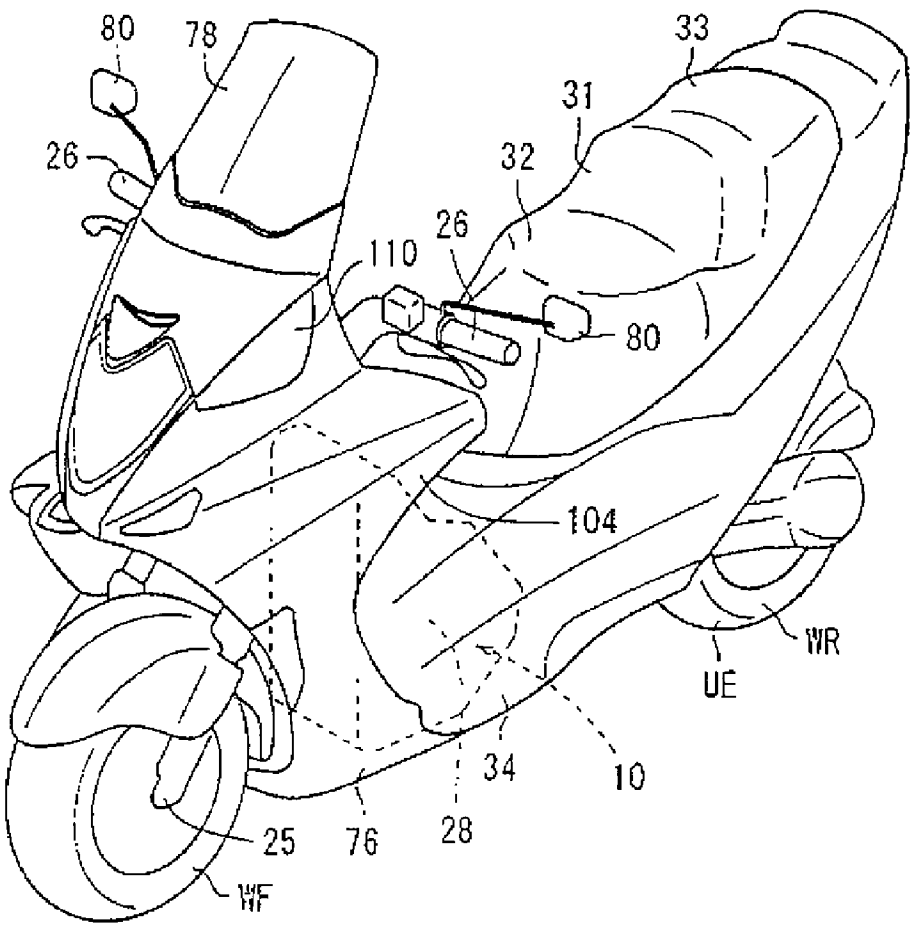
FIG. 2 is a perspective view showing the motorcycle on which the microbubble generator according to the embodiment is mounted.

Referring to FIGS. 1 and 2, a microbubble generator 10 according to the embodiment is mounted on a scooter type motorcycle 12. A motorcycle 12 which may be of a type other than the scooter type will be described hereinafter.

As shown in FIG. 1, the motorcycle 12 includes, at a front end, a head pipe 27 which steerably supports front forks 25 for journaling a front wheel WF, with a handlebar 26 connected to the front forks 25. A unit swing engine UE for supporting the rear wheel WR at the rear end is swingably supported at the center portion in the longitudinal direction of a vehicle body frame F. A fuel tank 28 with a radiator 29 disposed to the rear of the fuel tank 28 are provided on the vehicle body frame F to the front of the unit swing engine UE. A tandem seat 31 formed of a front seat 32 and a rear seat 33 is disposed at the rear portion of the vehicle body frame F. A plastic vehicle body cover 34 is attached to the vehicle body frame F to cover the vehicle body frame F, the front portion of the unit swing engine UE, the fuel tank 28, and the radiator 29.

The unit swing engine UE includes a water-cooled engine E with a substantially horizontal cylinder axis, and a belt type continuously variable transmission M for transmitting the output of the engine E to the rear wheel WR by performing a continuously variable transmission using the transmission belt and the pulley. The continuously variable transmission M drives the movable pulley at the crankshaft side in response to the operation of the electric motor 42 for transmission so as to continuously vary the transmission gear ratio.

A transmission case 43 of the continuously variable transmission M is provided adjacent to the left side of the crankcase 44 of the engine E to overhang leftward from the engine E, and extends to the left side of the rear wheel WR. A front end of the swing arm (not shown) is combined with the right side of the crankcase 44. The rear wheel WR is journaled between the rear end portion of the transmission case 43 and the rear end portion of the swing arm.

Upper ends of a pair of left and right rear cushions 64 are connected to the rear end portion of the vehicle body frame F. Each lower end of the rear cushions 64 is connected to the rear end portions of the transmission case 43 and the swing arm, respectively.

A storage box 70 for storing articles is disposed at the lower portion of the rider's seat 31, which extends from the lower front end of the rider's seat 31 to the portion around the upper part of the rear cushion 64. The storage box 70 has its upper surface covered with the rider's seat 31 serving as a lid. The inner space of the storage box is exposed by lifting the rider's seat 31 to the right.

A front cowl 76 of a vehicle body cover 34 includes a transparent wind screen 78 at the upper portion. The handlebar 26 includes a pair of left and right rear view mirrors 80. An inner cover 82 includes a leg shield 84 for covering the front of the legs of the rider, and a step holder 86. The fuel tank 28 is covered with an inner cover 82 and a filler opening cover 82 which can be opened/closed in the vicinity of the leg shield 84.

Figure 3:
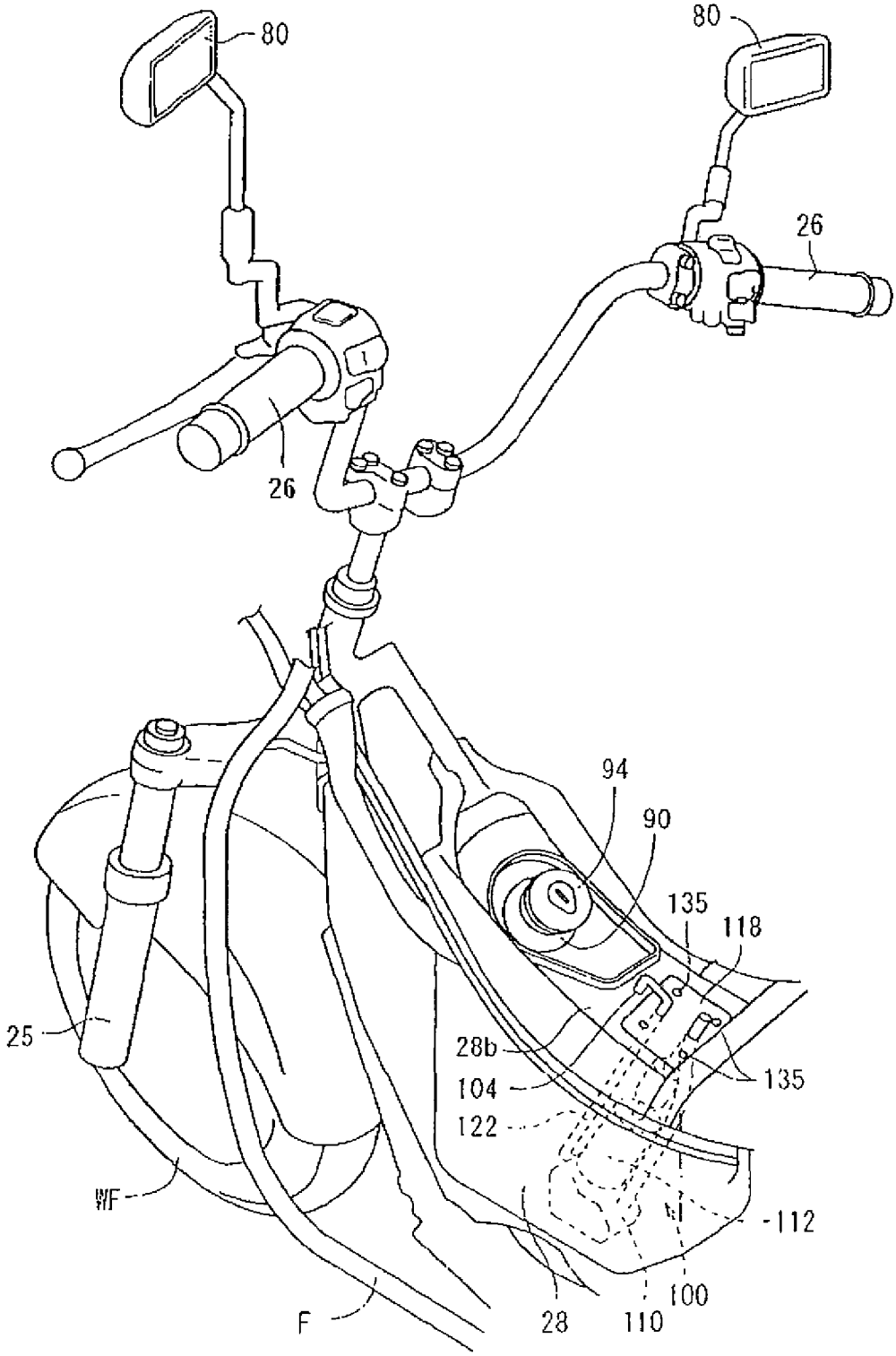
FIG. 3 is a perspective view showing a fuel tank of the motorcycle and the periphery thereof when the inner cover is removed.

Referring to FIG. 3, the fuel tank 28 is configured to have its width reduced toward the upper direction, and has a filter opening 90 directed diagonally downward around the upper end. The filler opening 90 is exposed by opening the filler opening cover 92 (see FIG. 1) and removing a tank cap 94 such that the fuel (gas and the like) may be filled into the fuel tank 28.

The microbubble generator 10 will be described hereinafter.

Figure 4:
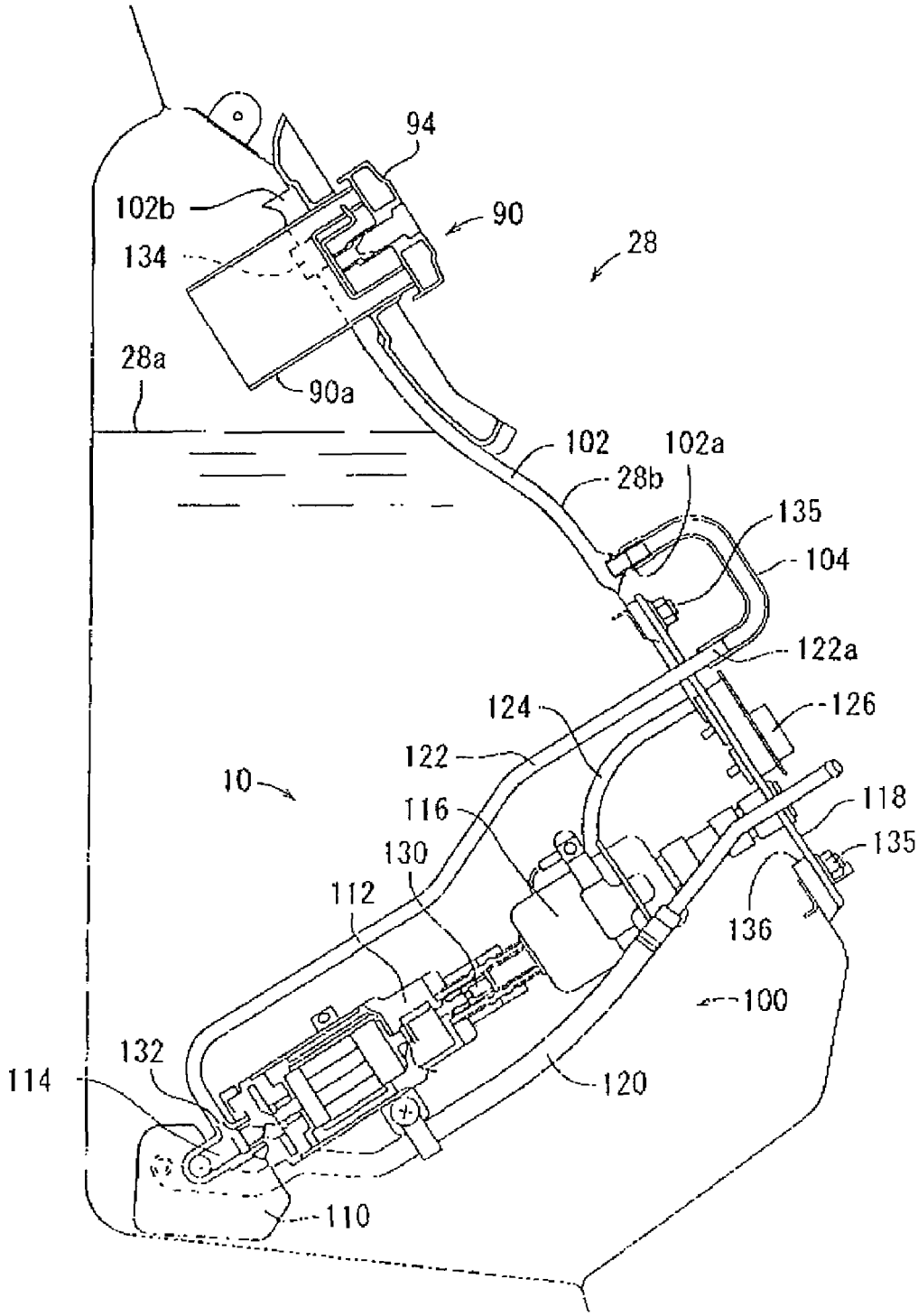
FIG. 4 is a sectional side elevation of the fuel tank which contains the microbubble generator.

Referring to FIG. 4, the microbubble generator 10 is disposed inside the fuel tank 28, and includes a pump unit 100, an intake air pipe (second pipe) 102, and a plastic joint tube (pipe) 104. The pump unit 100 is stored in a section with the largest width of the fuel tank 28.

Figure 5:
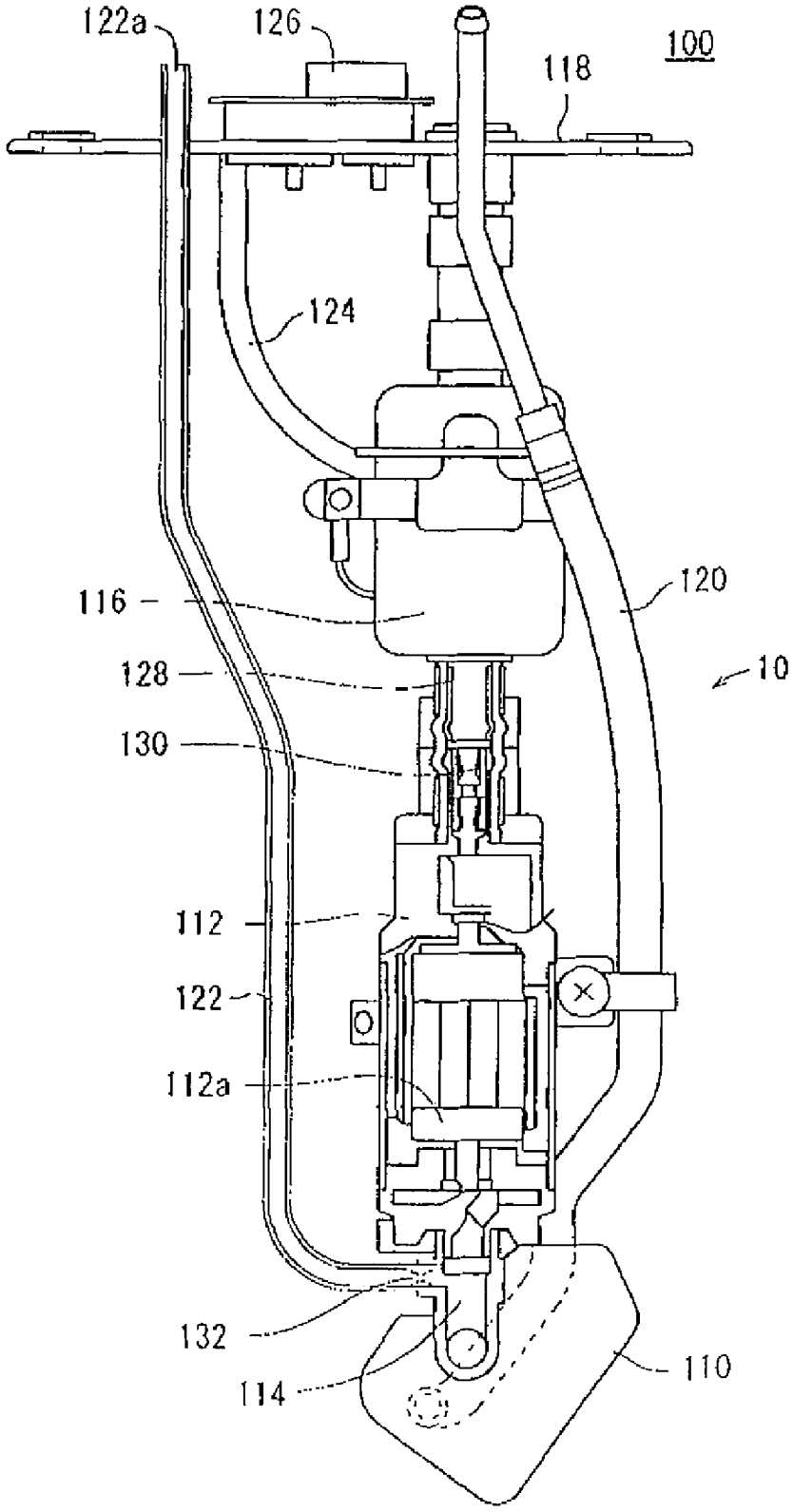
FIG. 5 is a sectional side elevation of a pump unit.

Referring to FIG. 5, the pump unit 100 includes a strainer 110 which sucks the fuel, a fuel pump 112 which supplies the fuel into a fuel injection unit or a carburetor (not shown) of the engine E (see FIG. 1), a short introduction pipe 114 for guiding the fuel from the strainer 110 to the inlet of the fuel pump 112, a fuel filter 116 disposed downstream of the fuel pump 112, and a lid 118 which partially forms a wall of the fuel tank 28. The pump unit 100 further includes a fuel return line 120 for returning the surplus fuel which has not been used in the fuel injection unit, a joint side air pipe (first pipe) 122 having one end joined with the introduction pipe 114 from the side, a harness 124 for supplying power to a pump motor 112*a*, and a connector 126 at the end portion of the harness 124. The connector 126 is fixed to the lid 118.

An air-bleeding unit may be formed in the fuel filter 116 for returning the large bubble into the intake air pipe 102 or the joint side air pipe 122.

An air filter 134 is disposed in the intermediate portion of the intake air pipe 102 to block intrusion of foreign matter into the fuel pump 112. The air filter 134 is disposed around the uppermost end of the intake air pipe 102 (or an air inlet 102*b*), which is constantly at a position higher than the liquid surface 28*a* so as not to be immersed in the fuel. The joint side air pipe 122 pierces through the lid 118 to slightly protrude outside. The protruding portion includes an opening 122*a*.

The fuel pump 112 and the fuel filter 116 are joined with an output side pipe 128 which contains a bubble generating orifice (microbubble generating unit) 130 therein. The fuel pump 112 and the bubble generating orifice 130 are positioned extremely adjacent with each other, thus allowing no equipment interposed therebetween.

Figure 6:
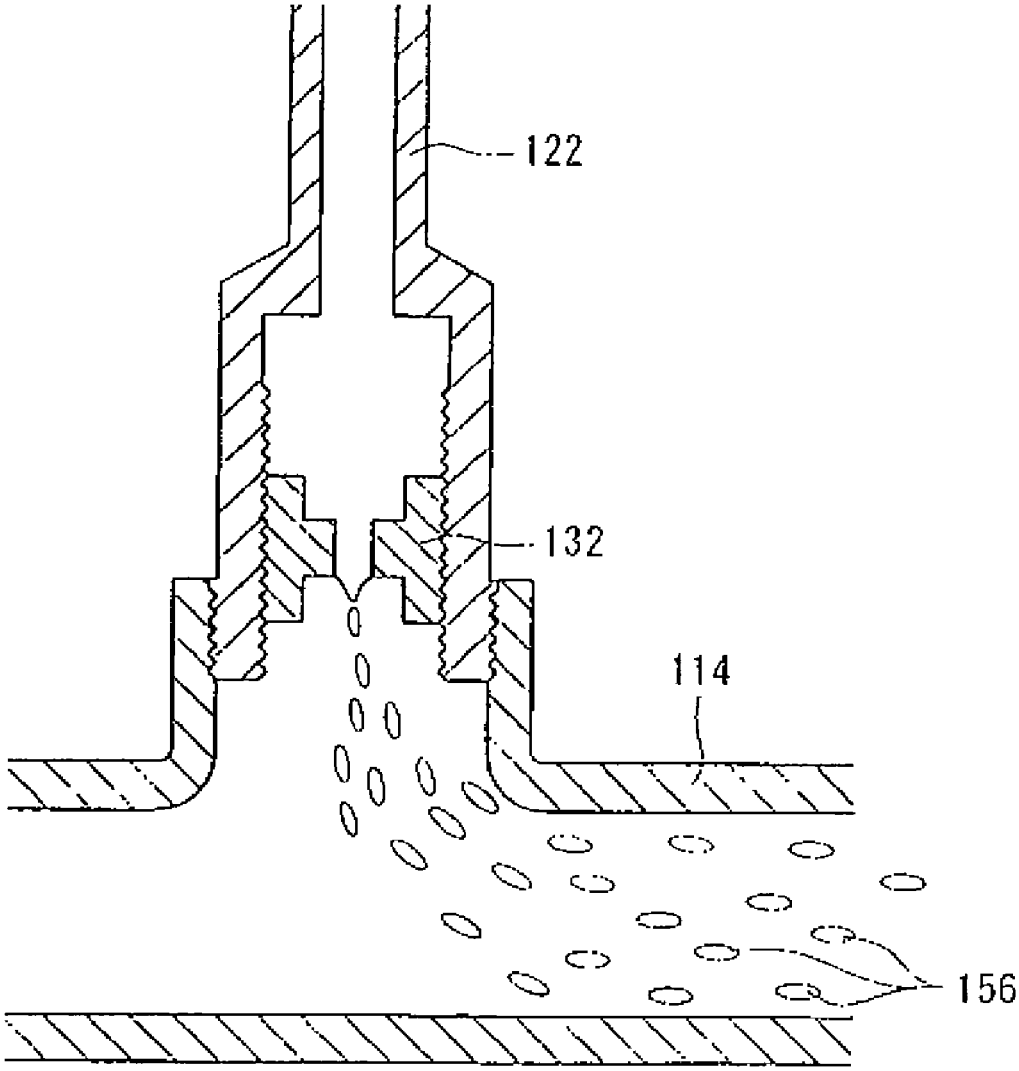
FIG. 6 is a sectional side elevation of a joint portion between the joint side air pipe and the introduction pipe.

Referring to FIG. 6, a joint portion (an end of the air pipe) between the joint side air pipe 122 and the introduction pipe 114 is provided with an air amount adjustment orifice 132. The joint side air pipe 122 is connected to the side of the introduction pipe 114 at substantially 90°. When the fuel flows through the introduction pipe 114, as the nature of fluid, air in the joint side air pipe 122 is sucked via the air amount adjustment orifice 132 so as to be mixed with the fuel. At this time, the bubble 156 which has been mixed has a large diameter to a certain extent. However, it is formed into the microbubble as it passes through the bubble generating orifice 130 via the fuel pump 112.

The air amount adjustment orifice 132 is threaded so as to be replaceable, and capable of adjusting the amount of air mixed with the fuel, thus defining the generation amount of the microbubble. The fuel filter 116 has a metal mesh structure to further refine the microbubble.

The above-structured pump unit 100 is fixed by screwing the lid 118 around the opening 136 of the fuel tank 28 using a plurality of bolts 135. The assembly to the fuel tank 28 and the maintenance work may be easily performed. A seal body is interposed between the lid 118 and the opening 136 of the fuel tank 28.

Referring to FIG. 4, the filler opening 90 has a cylindrical shape with a cylinder 90*a* protruding into the fuel tank 28 to an appropriate degree. The filler opening 90 slightly protrudes outside the fuel tank 28, and the tank cap 94 is detachably provided. The filler opening 90 is formed in a tilt surface 28*b* at the upper portion of the fuel tank 28. The opening 136 through which the pump unit 100 is inserted and fixed is provided at the portion slightly lower than the filler opening 90 in the surface 28*b*.

The intake air pipe 102 includes an opening 102*a* outside the portion where it pierces through the wall of the fuel tank 28 around the lid 118 (the portion other than the lid). This makes it possible to easily join the opening 102*a* with the opening 122*a* outside the fuel tank 28 using the joint tube 104, resulting in the simple assembly work. The intake air pipe 102 may be combined with the joint side air pipe 122 so as to be stored in the fuel tank 28 while omitting the use of the joint tube 104. All the components of the microbubble generator 10 may be stored in the fuel tank 28, which is convenience for the equipment layout.

The intake air pipe 102 extends from the portion where the wall of the fuel tank 28 at the lower portion of the opening 1 02*a* is pierced to the cylinder 90*a* along the inner wall of the fuel tank 28, and is fixed to the inner wall over the whole length. The intake air pipe 102 is stable when it is at least partially fixed to the wall of the fuel tank 28, and is applicable to the vibrating system such as the vehicle. The intake air pipe 102 may be fixed to the fuel tank 28 along its outer wall of the fuel tank 28.

The intake air pipe 102 is fixed to (or in contact with) the outer surface of the cylinder 90*a* over substantially half of the way, and has the air inlet 102*b* (the other end of the air pipe) around the highest portion of the cylinder 90*a*. The filler opening 90 is disposed at the high position so as not to be immersed in the fuel thus ensuring the introduction of air from the air inlet 102*b*. The cylinder 90*a* is structured to protrude into the inner hollow of the fuel tank 28, which is suitable for fixing the intake air pipe 102. As the air inlet 102*b* is opened inside the fuel tank 28, foreign matter is unlikely to intrude into the intake air pipe 102 and the joint side air pipe 122.

Figure 7:
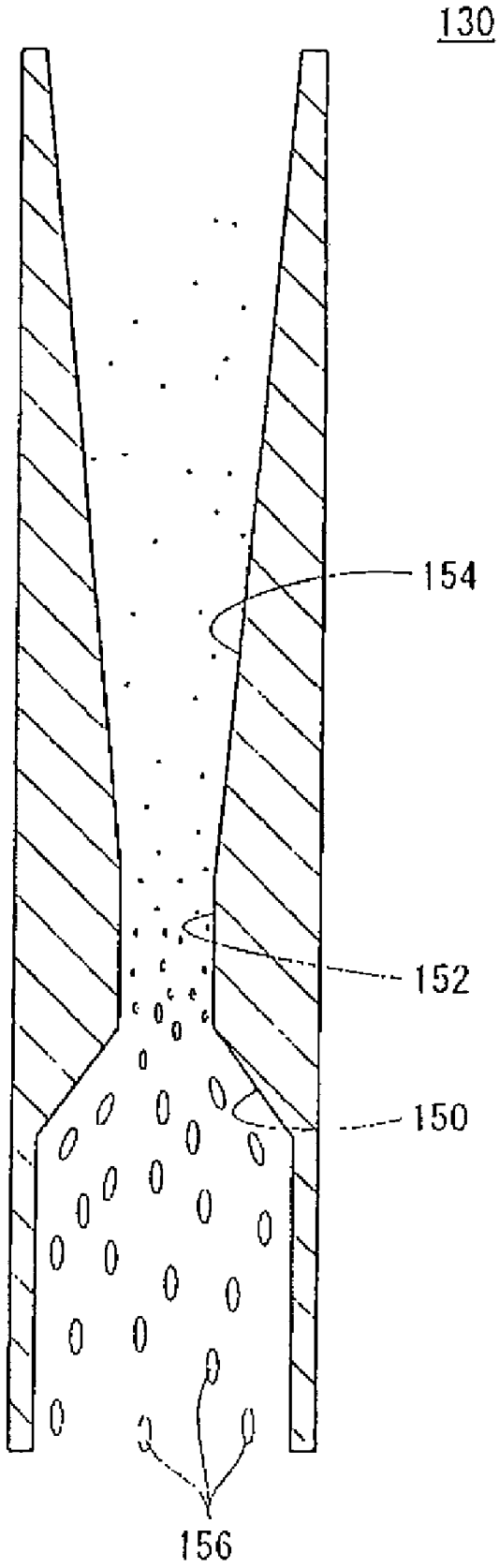
FIG. 7 is a sectional view of a bubble generating orifice.

Referring to FIG. 7, the bubble generating orifice 130 has a so called venturi shape formed of a first taper portion 150 having the diameter reduced from the input side to the output side, a throttle portion 152 with a diameter reduced by the first taper portion 150, and a second taper portion 154 having the diameter gradually increased toward the output side. The first taper portion 150 has the diameter rather sharply reduced toward the output side, and the second taper portion 154 has the diameter rather gently increased toward the output side. In the bubble generating orifice 130, as the fuel and the bubble 156 are pressurized at the accelerated rate in the first taper portion 150, the bubble 156 is likely to be crushed in the throttle portion 152 into the microbubble. Referring to FIG. 7, a large number of microbubbles are shown by dots. As the second taper portion 154 has the diameter gently increased, the microbubble generated in the throttle portion 152 is not subjected to the rapid influence, and allowed to flow downstream without being crushed. The bubble generating orifice 130 has a simple structure while being compact, light-weight and inexpensive.

The microbubble mixed with the fuel tends to deteriorate the kinetic viscosity of the fuel, and smoothly flows toward the fuel injection unit. Accordingly, the load exerted to the fuel pump 112 may be reduced.

An ultrasonic generator may be disposed between the fuel pump 112 and the fuel injection unit. As the ultrasonic wave is irradiated to the fuel through the ultrasonic generator, the temperature of the fuel may be made uniform, thus promoting refinement of the injected fuel.

As described above, the microbubble generator 10 according to the embodiment allows the joint side air pipe 122 as the air pipe to be joined with the introduction pipe 114 of the fuel pump 112, and the bubble generating orifice 130 to be disposed at the output side of the fuel pump 112, thus providing a compact and inexpensive device. The size of the microbubble generator 10 may be reduced by disposing the fuel pump 112 and the bubble generating orifice 130 to be close to each other.

Substantially all the components of the microbubble generator 10 are stored inside the fuel tank 28 without substantially increasing the capacity of the device, thus being suitable for the layout. When the microbubble generator 10 is provided, the capacity corresponding to the thin intake side air pipe 102 and the joint side air pipe 122 is only increased. The capacity of the fuel tank 28 is hardly reduced.

The microbubble generator 10, which is compact, light-weight, and inexpensive is preferably applicable to the motorcycle 12 with the limited layout space. However, it may be mounted on the motorcycle 12 or another vehicle for use other than the reduction of the kinetic viscosity. The microbubble generator 10 may be employed for the system other than the vehicle.

The microbubble generator according to the present invention may have various structures without being limited to the aforementioned embodiment so long as it does not depart from the scope of the invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A microbubble generator comprising:

a pump for pumping out a liquid;

an introduction pipe for introducing the liquid to an inlet of the pump;

an air pipe having one end joined with the introduction pipe, and the other end opened as an air inlet; and a microbubble generation unit disposed in an output side pipe of the pump, wherein the pump and the microbubble generation unit are disposed adjacent to each other.

2. The microbubble generator according to claim 1, wherein an air amount adjustment orifice is disposed at a joint between the air pipe and the introduction pipe.

3. The microbubble generator according to claim 2, wherein the air amount adjustment orifice is provided to be replaceable.

4. The microbubble generator according to claim 3, wherein a mesh filter is disposed downstream of the microbubble generating unit in the output side pipe.

5. The microbubble generator according to claim 2, wherein a mesh filter is disposed downstream of the microbubble generating unit in the output side pipe.

6. The microbubble generator according to claim 1, wherein a mesh filter is disposed downstream of the microbubble generating unit in the output side pipe.

7. The microbubble generator according to claim 1, wherein a filter is provided in the air pipe.

8. The microbubble generator according to claim 1, wherein the microbubble generating unit is an orifice with a tapered shape having a diameter reduced from an input side to an output side.

9. The microbubble generator according to claim 1, wherein: the liquid is used as a fuel for an internal combustion engine, and stored in a fuel tank;

the pump is a fuel pump; and the pump and the microbubble generating unit are disposed in the fuel tank.

10. The microbubble generator according to claim 9, wherein the microbubble generator is applied to a motorcycle.

11. The microbubble generator according to claim 9, wherein the air pipe is in contact with or fixed to an outer surface of a filler opening cylinder of the fuel tank.

12. The microbubble generator according to claim 11, wherein the microbubble generator is applied to a motorcycle.

13. The microbubble generator according to claim 9, wherein at least a portion of the air pipe is fixed to a wall of the fuel tank.

14. The microbubble generator according to claim 13, wherein the microbubble generator is applied to a motorcycle.

15. The microbubble generator according to claim 9, wherein the air pipe is a unit formed by combining a lid which forms a portion of a wall of the fuel tank, the pump and the microbubble generating unit.

16. The microbubble generator according to claim 15, wherein the microbubble generator is applied to a motorcycle.

17. The microbubble generator according to claim 9, wherein the air pipe is formed of a first pipe which includes the one end, a second pipe which includes the other end, and a joint pipe which connects the first and the second pipes;

the first pipe is a unit formed by combining a lid which forms a portion of a wall of the fuel tank, the pump and the microbubble generating unit;

the second pipe is fixed to a portion of the fuel tank other than the lid; and the joint pipe connects openings of the first and the second pipes.

18. The microbubble generator according to claim 17, wherein the first pipe includes an external opening through the lid; and the second pipe includes an external opening through a wall of the fuel tank at a portion other than the lid.

19. The microbubble generator according to claim 17, wherein the microbubble generator is applied to a motorcycle.

20. The microbubble generator according to claim 9, wherein the other end of the air pipe is opened inside the fuel tank.

* * * * *